US009940800B2

(12) United States Patent
Li et al.

(10) Patent No.: US 9,940,800 B2
(45) Date of Patent: Apr. 10, 2018

(54) ANTI-THEFT ALARM DEVICE WITH HIGH CHARGING EFFICIENCY

(71) Applicant: KUNMING QUASION TECH CO., LTD., Yunnan (CN)

(72) Inventors: Xiaolong Li, Beijing (CN); Xiaohua Wu, Beijing (CN); Ziyue Ouyang, Beijing (CN)

(73) Assignee: KUNMING QUASION TECH CO., LTD., Yunnan (CN)

( * ) Notice: Subject to any disclaimer, the term of this patent is extended or adjusted under 35 U.S.C. 154(b) by 0 days.

(21) Appl. No.: 15/304,069

(22) PCT Filed: Apr. 17, 2014

(86) PCT No.: PCT/CN2014/075561

§ 371 (c)(1),
(2) Date: Oct. 14, 2016

(87) PCT Pub. No.: WO2015/157956

PCT Pub. Date: Oct. 22, 2015

(65) Prior Publication Data

US 2017/0039827 A1 Feb. 9, 2017

(51) Int. Cl.
*G08B 13/14* (2006.01)
*G08B 13/00* (2006.01)

(52) U.S. Cl.
CPC ..... *G08B 13/1409* (2013.01); *G08B 13/00* (2013.01); *G08B 13/149* (2013.01); *G08B 13/1445* (2013.01)

(58) Field of Classification Search
CPC .... G08B 13/1409; G08B 13/14; G08B 13/02; G08B 13/00
See application file for complete search history.

(56) References Cited

U.S. PATENT DOCUMENTS

2013/0307692 A1 11/2013 Fawcett et al.
2015/0091729 A1* 4/2015 Phillips ..... G08B 13/1427 340/568.2

FOREIGN PATENT DOCUMENTS

CN 203165115 * 8/2013
CN 203217683 9/2013
(Continued)

OTHER PUBLICATIONS

Office Action issued by the Japanese Patent Office dated Dec. 26, 2017 for JP2017505690; European Search Report dated Jan. 3, 2018 for PCT/CN2014075561.

*Primary Examiner* — Hongmin Fan
(74) *Attorney, Agent, or Firm* — Chieh-Mei Wang

(57) ABSTRACT

An anti-theft alarm device for protecting an electronic device from theft, includes a host, a connecting member and an alarm wire. The host includes a main control device, a charging contactor and an internal connecting wire. The charging contactor is connected to the main control device by the internal connecting wire in the host. The connecting member is fixedly attached to the electronic device and includes a charging terminal, a charging wire and an alarm connecting wire. The charging terminal and the charging wire are electrically connected. The charging wire is for connecting a charging port of the electronic device. The alarm connecting wire is for connecting the alarm wire and the electronic device. The alarm wire is for connecting the alarm connecting wire and the main control device. The charging contactor and the charging terminal are electrically connected when the host and the connecting member are mechanically connected.

14 Claims, 3 Drawing Sheets

(56) References Cited

FOREIGN PATENT DOCUMENTS

| | | |
|---|---|---|
| JP | 2008103163 | 5/2008 |
| JP | 2010140388 | 6/2010 |
| JP | 2013003937 | 1/2013 |
| JP | 2013186795 | 9/2013 |
| JP | 2013538406 | 10/2013 |

* cited by examiner

ANTI-THEFT ALARM DEVICE WITH HIGH CHARGING EFFICIENCY

FIELD OF THE INVENTION

The present invention relates to an anti-theft alarm device, and more particularly to an anti-theft alarm device with high charging efficiency in the technical field of anti theft.

BACKGROUND OF THE INVENTION

In retailer and exhibition establishments, anti-thief device is used for protecting displayed device from theft. For example, in retailer and exhibition of electronic devices such as mobile phone, digital camera and tablet computer, the exhibited electronic devices are usually electrically connected to a remove-proof device on a display table. When a customer tries to operate and assess the function of an electronic device, the consumer can operate the electronic device directly without disconnecting the electronic device from the remove-proof device; otherwise, the remove-proof device would alarm if the electronic device is disconnected from the remove-proofer device.

The existing anti-theft alarm device is connected to the protected electronic device by an alarm wire. When the alarm wire is disconnected, the anti-theft alarm device would alarm. The alarm wire also provides charging function for the protected electronic device. In general, the alarm wire has a length of about 1.5-2.5 m and an internal resistance about 0.2-1Ω, which may lead to problems such as voltage decay, slow charging or incomplete charging. For example, when a 1 amp (A) current is used for charging a protected electronic device through an alarm wire with a 1-Ω internal resistance, 5 volt (V) voltage outputted from a recharger may decay to 4 V when supplied to the charging terminal of the electronic device, leading to the problems of slow charging or even incomplete charging.

SUMMARY OF THE INVENTION

(A) The Technical Problems to be Solved

One objective of the present invention is to provide an anti-theft alarm device capable solving the problem of having too long charging time and poor charging efficiency in prior art.

(B) Technical Scheme

In order to solve the aforementioned technical problems, the present invention provides an anti-theft alarm device for protecting an electronic device from theft. The anti-theft alarm device includes a host, a connecting member and an alarm wire. The host includes a main control device, a charging contactor and an internal connecting wire. The charging contactor is connected to the main control device by the internal connecting wire disposed in the host. The connecting member is fixedly attached to the electronic device and includes a charging terminal, a charging wire and an alarm connecting wire. The charging terminal and the charging wire are electrically connected to each other. The charging wire is used for connecting a charging port of the electronic device. The alarm connecting wire is used for connecting the alarm wire and the electronic device. The alarm wire is used for connecting the alarm connecting wire and the main control device. The charging contactor and the charging terminal are electrically connected to each other when the host and the connecting member are mechanically connected to each other.

In one embodiment according to the present invention, the host further includes an elastic element configured to provide a stress when the charging terminal and the charging contactor are contacted to each other.

In one embodiment according to the present invention, the connecting member further includes an elastic element configured to provide a stress when the charging terminal and the charging contactor are contacted to each other.

In one embodiment according to the present invention, the elastic element is a gold-plated spring.

In one embodiment according to the present invention, the main control device includes a power management module. The power management module, the internal connecting wire, the charging contactor, the charging terminal, the charging wire and the electronic device constitute a charging loop. The power management module is configured to charge the electronic device via the charging loop.

In one embodiment according to the present invention, the main control device includes an alarm detection module. The alarm detection module, the alarm wire, the alarm connecting wire and the electronic device constitute an alarm loop. The alarm detection module is configured to detect whether the alarm loop has an abnormal event.

In one embodiment according to the present invention, the connecting member is adhered to a surface of the electronic device when the connecting member is in use.

In one embodiment according to the present invention, both of the host and the connecting member includes a fixed connecting mechanism. The host and the connecting member are fixedly connected to or detached from each other through the fixed connecting mechanisms.

In one embodiment according to the present invention, the charging wire is a low-resistance wire.

In one embodiment according to the present invention, the alarm wire is a flexible cable.

In one embodiment according to the present invention, the charging contactor is a gold-plated copper sheet.

In one embodiment according to the present invention, the charging terminal is a gold-plated copper terminal.

In one embodiment according to the present invention, the alarm connecting wire is connected to the electronic device by a Micro USB, a Mini USB Micro or a Lightning.

(C) Beneficial Effect

Through the design of separating the alarm wire and the charging wire and shortening the length of the charging wire using an unique mechanical structure to reduce the internal resistance to lower than 0.1 ohm, the anti-theft alarm device of the present invention has minimal wire loss, reduced charging time and improved charging quality when charging the electronic device to be protected.

BRIEF DESCRIPTION OF THE DRAWINGS

Other advantages, objectives and features of the present invention will become apparent from the following description referring to the attached drawings.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
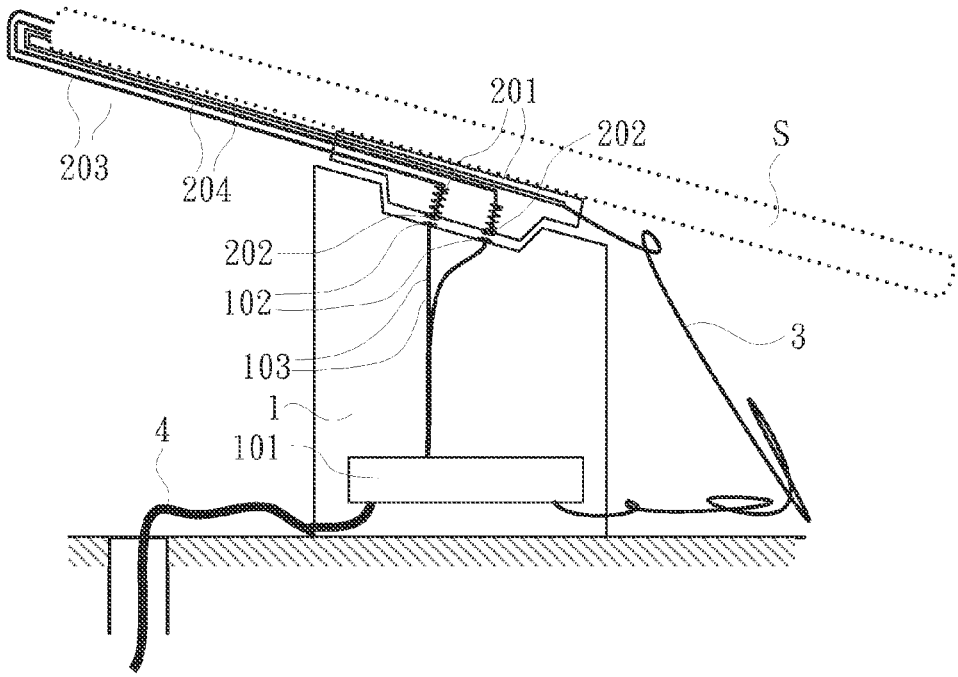
FIG. 1 is a schematic diagram illustrating the working principle of an anti-theft alarm device in accordance with an embodiment of the present invention.
Figure 2:
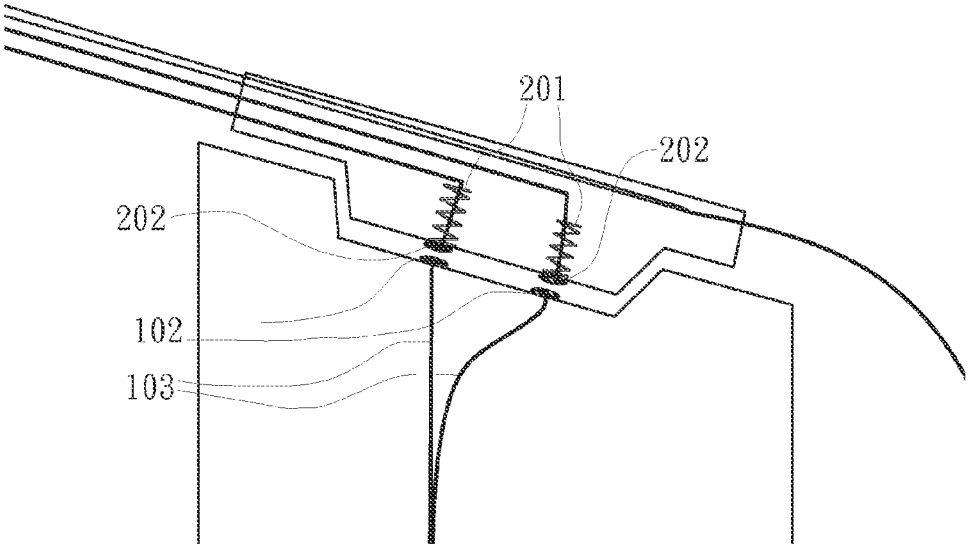
FIG. 2 is a schematic enlarged diagram of a portion of the anti-theft alarm device in FIG. 1.

FIG. 1 is a schematic diagram illustrating the working principle of an anti-theft alarm device in accordance with an embodiment of the present invention. FIG. 2 is a schematic enlarged diagram of a portion of the anti-theft alarm device in FIG. 1.

As shown in FIGS. 1 and 2, the anti-theft alarm device of the present embodiment includes a host 1, a connecting member 2 and an alarm wire 3. In general, the host 1 is fixed on a fixed object not easily moved such as a desktop while the anti-theft alarm device is in used. The connecting member 2 is fixedly attached to a protected electronic device S while the connecting member 2 is in use. The electronic device S is, for example, a mobile phone, a portable computer, a tablet PC, an electronic book or a digital camera, which usually has a rechargeable battery chargeable by an external charging circuit. The alarm wire 3 is used for connecting the host 1 and the connecting member 2.

As shown in FIG. 1, the host 1 includes a main control device 101, a charging contactor 102 and an internal connecting wire 103. The charging contactor 102 is connected to the main control device 101 by the internal connecting wire 103 disposed in the host 1. The connecting member 2 includes a charging terminal 202, a charging wire 203 and an alarm connecting wire 204. The charging terminal 202 and the charging wire 203 are electrically connected to each other. The charging wire 203 is used for connecting a charging port of the protected electronic device S. The alarm connecting wire 204 is used for connecting the alarm wire 3 and the protected electronic device S. The alarm wire 3 is used for connecting the alarm connecting wire 204 and the main control device 101 of the host 1.

The alarm connecting wire 204 and the electronic device S are connected to each other by a connector such as Micro USB, Mini USB Micro or Lightning.

The number/quantity of the charging wire 203, the internal connecting wire 103 and the alarm connecting wire 204 are two. In FIGS. 1 and 2, the illustrated number/quantity of the charging wire 203 and the alarm connecting wire 204 are two; in fact, although not shown in the figures, the number/quantity of the internal connecting wire 103 and the alarm wire 3 also are two.

And thus, the main control device 101, the alarm wire 3, the alarm connecting wire 204 and the protected electronic device S constitute an alarm loop.

The host 1 and the connecting member 2 may be mechanically connected to each other and the positions of the charging contactor 102 of the host 1 and the charging terminal 202 of the connecting member 2 are corresponding to each other. Therefore, the charging contactor 102 and the charging terminal 202 can be electrically contacted to each other when the host 1 and the connecting member 2 are mechanically connected to each other. And thus, the main control device 101, the internal connecting wire 103, the charging contactor 102, the charging terminal 202, the charging wire 203 and the protected electronic device S constitute a charging loop when the charging contactor 102 and the charging terminal 202 are contacted to each other.

Figure 3:
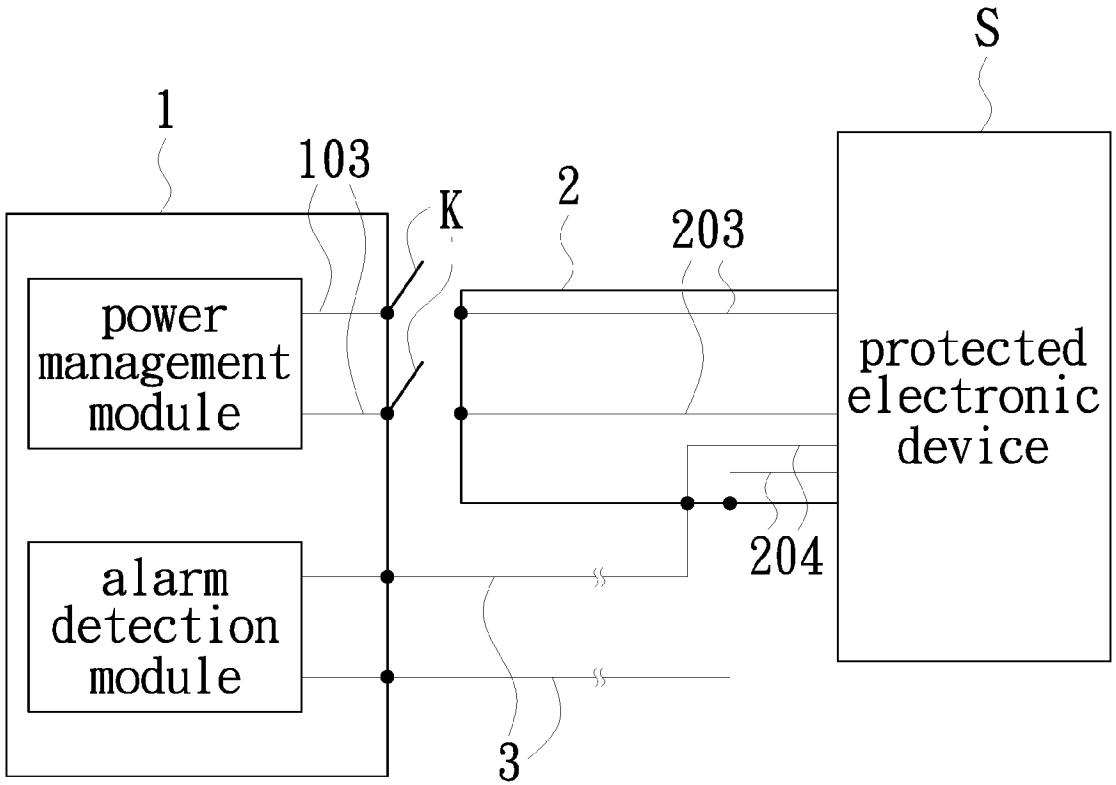
FIG. 3 is a circuit diagram of an anti-theft alarm device in accordance with an embodiment of the present invention.

The main control device 101 of the present embodiment includes a power management module (as shown in FIG. 3) configured to manage the supply of the internal or external power and charge the protected electronic device S via the aforementioned charging loop. The main control device 101 further includes an alarm detection module (as shown in FIG. 3) configured to receive a signal from the alarm wire 3 to detect whether the aforementioned alarm loop has an abnormal event.

Therefore, in the present embodiment, the charging loop is connected to the main control device 101 by the internal connecting wire 103 of the host 1, and the alarm loop is connected to the main control device 101 by the alarm wire 3. Thus, the alarm wire 3 can be set to have a certain length, such as a few meters, allowing a user to perform an operation on the protected electronic device S. Consequently, integration of the alarm wire 3 with the charging wire 203 into one cable is avoided and the charging wire 203 would not result in an unnecessarily long length; as a result, the charging efficiency would be improved. In the present embodiment, the charging loop and the alarm loop are disposed independently; and thus, the routing length of the charging loop is shortened, wire loss is reduced, charging efficiency is increased and charging time is reduced.

In FIG. 1, the main control device 101 is connected to an external power source by a main power source line 4, but the present invention is not limited thereto. The host 1 may adopts an internal power source in another embodiment.

In one preferred embodiment as shown in FIGS. 1 and 2, an elastic element 201 (e.g., a spring) is disposed in the connecting member 2 and connected to the charging terminal 202. The elastic element 201 is configured to provide the charging terminal 202 with a stress while the charging terminal 202 and the charging contactor 102 are contacted to each other, thereby forming a reliable electrical contact between the charging terminal 202 and the charging contactor 102. It is to be understood that the elastic element 201 may be disposed in the host 1 in another embodiment, or, the elastic element 201 may be disposed in both of the connecting member 2 and the host 1 in still another embodiment.

FIG. 3 is a circuit diagram of an anti-theft alarm device in accordance with an embodiment of the present invention. In FIG. 3, the charging terminal 202 and the charging contactor 102 are simplified as a contact switch K. As described above, the main control device 101 includes the power management module and the alarm detection module. As shown in FIG. 3, the connecting member 2 is connected to the power management module via the contact switch K. Specifically, the connecting member 2 and the host 1 are contacted to each other and the power management module supplies power to the electronic device S when the contact switch K is switched off (or conductive). On the contrary, the alarm detection module is always connected to the connecting member 2 via the alarm wire 3. That is, the alarm loop is always conductive and the anti-theft function never terminates even when the contact switch K is switched off (or conductive) or the connecting member 2 and the host 1 are not in contact with each other.

Figure 4:
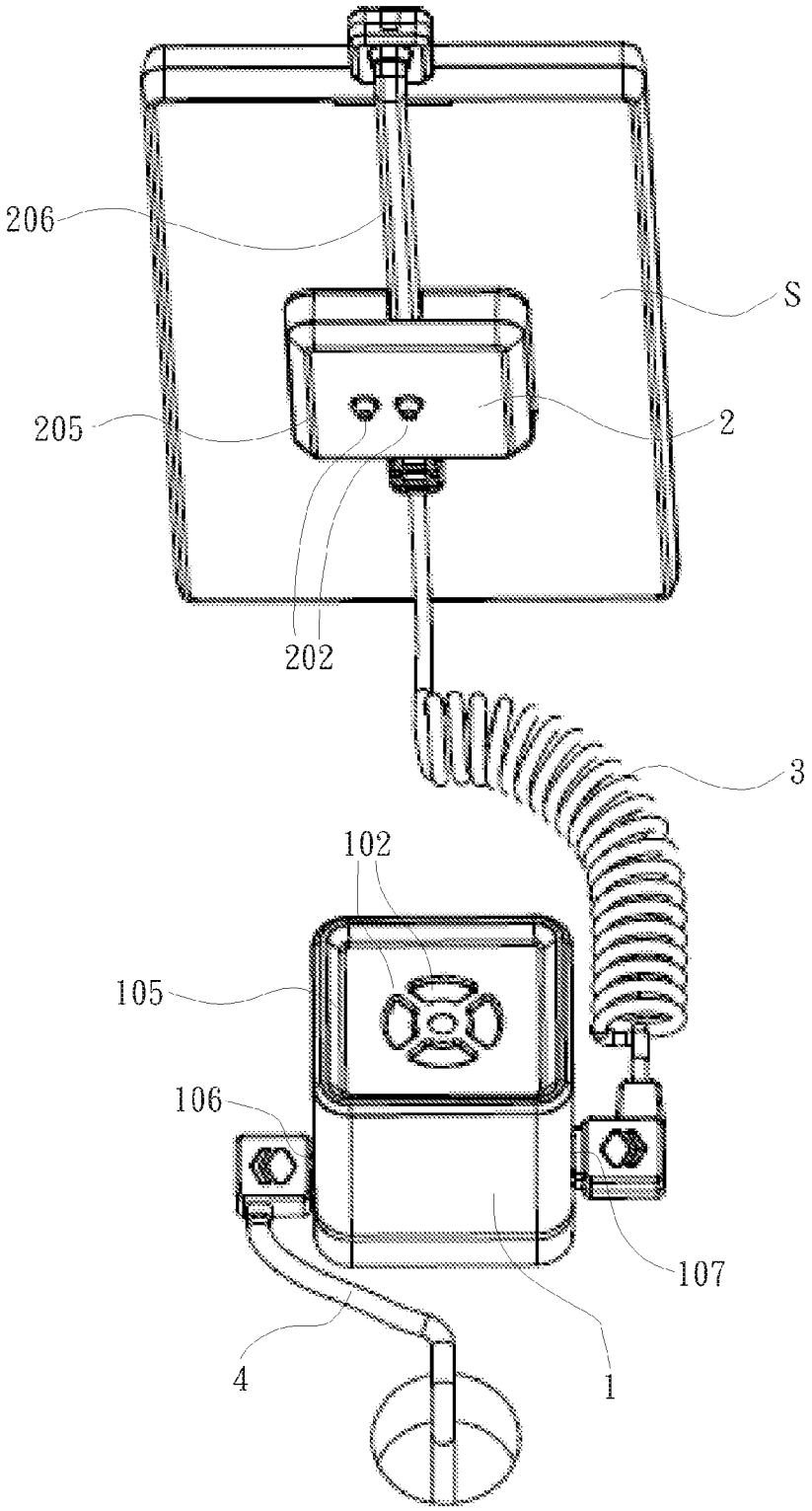
FIG. 4 is a schematic diagram illustrating the connections of an anti-theft alarm device in accordance with an embodiment of the present invention.

The anti-theft alarm device of the present invention will be further described by the following embodiment. FIG. 4 is a schematic diagram illustrating the connection of an anti-theft alarm device in accordance with an embodiment of the present invention. As shown in FIG. 4, the anti-theft alarm device of the present embodiment mainly includes two independent components, which are the host 1 and the connecting member 2. The host 1 and the connecting member 2 are composed of a casing and circuit elements in the casing. The electronic device S to be protected is a mobile phone in the present embodiment.

The casing of the connecting member 2 has two opposite surfaces, one is a top connecting surface for connecting the electronic device S (in the present embodiment, the top connecting surface is referred to as the surface of the connecting member 2 to which the electronic device S is adhered) and the other is a bottom connecting surface for connecting the host 1. An opening is formed on the bottom connecting surface, and through the opening the charging terminal 202 extends out from the bottom connecting surface. In addition, the bottom connecting surface is further provided with a securing connection mechanism 205 connected to the host 1. In the present embodiment, the securing connection mechanism 205 is a mechanical mechanism with wedged or grooved positioning. Therefore, by utilizing the securing connection mechanism 205, the connecting member 2 can be fixedly connected to and detached from the host 1 conveniently; further, the connection between the connecting member 2 and the host 1 has certain strength while the connecting member 2 is fixedly connected to the host 1. However, it is to be understood that the specific structure and design of the fixed connecting mechanism 205 are not limited in the present invention.

The casing of the host 1 has a bottom surface and a top surface. The bottom surface of the casing of the host 1 is fixedly attached to a fixed object and the top surface of the casing of the host 1 is used for fixedly connecting to the bottom connecting surface of the connecting member 2. Correspondingly, the top surface of the casing of the host 1 can also be provided with a securing connection mechanism 105 corresponding to the connecting member 2, so as to facilitate the fixed connection between the fixed connecting mechanism 105 and the connecting member 2. An opening is formed on the top surface of the casing of the host 1, and through the opening the charging contactor 102 of the host 1 extends out from the casing. It is to be noted that close contact between the charging contactor 102 of the host 1 and the charging terminal 202 of the connecting member 2 is required when the connecting member 2 and the host 1 are connected to each other by the respective securing connection mechanisms 205 and 105.

In the present embodiment, the charging contactor 102 is a gold-plated copper sheet; the charging terminal 202 is a gold-plated copper terminal; and the elastic element 201 is a gold-plated spring. However, it is to be understood that the specific structures of the charging contactor 102 and the charging terminal 202 are not limited in the present invention.

In addition, the connecting member 2 further includes a cable 206 for accommodating the charging wire 203 and the alarm connecting wire 204. The cable 206 extends out from the casing of the connecting member 2 through an opening formed on a side surface of the casing. In the present embodiment, the charging wire 203 is a low-resistance wire. One end of the charging wire 203 is a connection port matching the charging port of the electronic device S (e.g., a mobile phone). The alarm connecting wire 204 is a common wire, which is connected to the electronic device S (e.g., a mobile phone) by a connector, such as Micro USB, Mini USB Micro or Lightning, and thereby forming the alarm loop.

Inside the casing of the connecting member 2, both of the charging wire 203 and the alarm wire 3 are connected to the charging terminal 202. The charging terminal 202 is further connected to a compression spring so as to provide a certain elastic support force while the charging contactor 102 is being connected.

The side surface of the casing of the host 1 is provided with a power source jack 106 for the external power source line and an alarm wire jack 107 for the alarm wire 3. The inside of the casing of the host 1 is provided with the main control device 101, which includes the power management module, the alarm detection module, a main control module and an alarm module. The power management module is configured to charge the electronic device S. The alarm detection module is configured to detect whether the alarm loop is closed (or conductive). Specifically, the alarm detection module reports to the main control module when an abnormal event, such as circuit disconnection, occurs; and consequently, the main control module controls the alarm module to set off an alarm. The power management module of the host 1 of the present embodiment is connected to the external power source by the main power source line 4.

In the present embodiment, the alarm wire 3 is a flexible cable with a length of about 0.4-2 m (for example, 1 m), thereby facilitating the user to take the electronic device S (e.g., a mobile phone) along with the connecting member 2 from the host 1 for operation.

Preferably, the shape of the top of the casing of the host 1 matches with the shape of the bottom of the connecting member 2, so as to facilitate the fixed connection of the securing connection mechanisms 105 and 205 and to ensure that the connection is not easily loosen.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An anti-theft alarm device for protecting an electronic device from theft, the anti-theft alarm device comprising a host, a connecting member and an alarm wire, wherein the host comprises a main control device, a charging contactor and an internal connecting wire, wherein the charging contactor is connected to the main control device by the internal connecting wire disposed in the host, the connecting member is fixedly attached to the electronic device and comprises a charging terminal, a charging wire and an alarm connecting wire, wherein the charging terminal and the charging wire are electrically connected, the charging wire is used for connecting a charging port of the electronic device, and the alarm connecting wire is used for connecting the alarm wire and the electronic device, the alarm wire is used for connecting the alarm connecting wire and the main control device, wherein the charging contactor and the charging terminal are electrically connected when the host and the connecting member are mechanically connected.

2. The anti-theft alarm device according to claim 1, wherein the host further comprises an elastic element configured to provide a stress when the charging terminal and the charging contactor are in contact with each other.

3. The anti-theft alarm device according to claim 1, wherein the connecting member further comprises an elastic element configured to provide a stress when the charging terminal and the charging contactor are in contact with each other.

4. The anti-theft alarm device according to claim 2, wherein the elastic element is a gold-plated spring.

5. The anti-theft alarm device according to claim 3, wherein the elastic element is a gold-plated spring.

6. The anti-theft alarm device according to claim 1, wherein the main control device comprises a power management module, wherein the power management module, the internal connecting wire, the charging contactor, the charging terminal, the charging wire and the electronic device constitute a charging loop, and the power management module is configured to charge the electronic device via the charging loop.

7. The anti-theft alarm device according to claim 1, wherein the main control device comprises an alarm detection module, wherein the alarm detection module, the alarm wire, the alarm connecting wire and the electronic device constitute an alarm loop, and the alarm detection module is configured to detect whether the alarm loop has an abnormal event.

8. The anti-theft alarm device according to claim 1 wherein the connecting member is adhered to a surface of the electronic device when the connecting member is in use.

9. The anti-theft alarm device according to claim 1, wherein the host and the connecting member each comprises a securing connection mechanism, and the host and the connecting member are fixedly connected to or detached from each other by the securing connection mechanisms.

10. The anti-theft alarm device according to claim 1, wherein the charging wire is a low-resistance wire.

11. The anti-theft alarm device according to claim 1, wherein the alarm wire is a flexible cable.

12. The anti-theft alarm device according to claim 1, wherein the charging contactor is a gold-plated copper sheet.

13. The anti-theft alarm device according to claim 1, wherein the charging terminal is a gold-plated copper terminal.

14. The anti-theft alarm device according to claim 1, wherein the alarm connecting wire is connected to the electronic device by a Micro USB, a Mini USB Micro or a Lightning.

* * * * *